US005595203A

United States Patent [19]

Espinosa

[11] Patent Number: 5,595,203

[45] Date of Patent: Jan. 21, 1997

[54] STRESSED ARCH STRUCTURES

[76] Inventor: Mark A. Espinosa, 1162 Phyllis Ct., Mountain View, Calif. 94040

[21] Appl. No.: 494,973

[22] Filed: Jun. 26, 1995

[51] Int. Cl.[6] ..... E04H 15/36

[52] U.S. Cl. ..... 135/124; 135/123; 135/138; 52/86

[58] Field of Search ..... 135/97, 123, 124, 135/125, 128, 136, 138, 139, 137; 52/86, 63

[56] References Cited

U.S. PATENT DOCUMENTS

| | | | |
|---|---|---|---|
| 2,144,747 | 1/1939 | Adams . | |
| 2,677,384 | 5/1954 | Luisada | 135/97 X |
| 3,088,244 | 5/1963 | Commisso | 135/97 X |
| 3,165,110 | 1/1965 | Brooks | 135/124 |
| 3,424,178 | 1/1969 | Yazaki . | |
| 3,798,851 | 3/1974 | Utahara | 135/124 X |
| 3,800,814 | 4/1974 | Hibbert . | |
| 3,855,643 | 12/1974 | Sanford . | |
| 3,970,096 | 7/1976 | Nicolai . | |
| 4,121,604 | 10/1978 | Rain . | |
| 4,404,980 | 9/1983 | Wade | 135/97 X |
| 4,433,700 | 2/1984 | Dohet | 135/97 |
| 4,739,784 | 4/1988 | Fast | 135/123 X |

FOREIGN PATENT DOCUMENTS

| | | | |
|---|---|---|---|
| 796740 | 4/1936 | France . | |
| 291755 | 9/1916 | Germany . | |
| 1195460 | 6/1965 | Germany | 135/124 |
| 623900 | 5/1949 | United Kingdom . | |

OTHER PUBLICATIONS

"Porta–Greens" Standard Tube and T. I. Limited 1959.

*Primary Examiner*—Lanna Mai
*Attorney, Agent, or Firm*—Richard C. Litman

[57] ABSTRACT

A portable stressed arch structure is constructed by assembling an essentially flat, planar frame of straight, uncurved components, and then drawing two opposite sides together and securing them with tension cables to hold the frame in an arch configuration. The arched framework is then covered with a conventional tarp or the like, as desired. The structure may be formed substantially of conventional polyvinyl chloride or other plastic pipe or tube, and may also utilize modified or specially formed connectors and other components. Supplementary bracing and other components may be added as desired or as needed, depending upon anticipated loads and size of the completed structure. Structures may be formed having relatively widely spaced arched ribs, or alternatively may be constructed having two or more adjacent ribs joined by common specialized connectors. The result is an easily assembleable and economical structure suitable for use as a shelter for boats, cars, and/or other relatively large objects, and/or for use as a garden or yard shed or the like, as desired.

20 Claims, 7 Drawing Sheets

STRESSED ARCH STRUCTURES

FIELD OF THE INVENTION

The present invention relates generally to portable framed structures, and more specifically to a temporary or semi-permanent structure formed of an assembly of straight frame members which opposite edges are drawn together to form an arched structure. The frame members are then covered with a flexible sheet material.

BACKGROUND OF THE INVENTION

Many persons have various relatively large articles (boats, automobiles. Garden tractors and equipment, etc.) which are better maintained if protected under some form of cover or shelter. Yet, in many cases it can be difficult, if not impossible, to erect a permanent structure to house such articles and equipment, either due to building restrictions, inability to construct improvements on rented or leased property or space, limitations due to the expense of such permanent structures, etc.

While a tarp or the like may be thrown over such articles and tied down, this is not a desirable means of protecting such equipment, as wind will create movement of the tarp against the finish of the equipment, leading to possible damage, and a close fitting tarp tends to trap moisture thereunder, which is also damaging to equipment and machinery. Moreover, it s generally nearly impossible to draw a tarp tightly over an irregular form such as a boat or other equipment and any loose fitting area will tend to flap in the wind, resulting in the rapid destruction of the tarp.

In response to the above problem, numerous light frame structures have been developed in the past, but those which are sufficiently large and durable to serve as a frame and/or shelter for such large articles as boats and cars, generally require (1) permanent attachment to a foundation or underlying structure, (2) relatively complex and time consuming assembly procedures, and/or (3) various specialized tools and equipment. Simpler structures which have been developed, are inadequate for sheltering larger objects having a size on the order of a boat or an automobile.

Accordingly, a need will be seen for a portable structure which may be constructed in a size sufficient to shelter a boat, automobile, and/or other large equipment, yet does not require permanent attachment to a foundation or other underlying structure. The structure must be asembleable from relatively simple components in a generally flat, planar framework, with opposite sides of the framework being drawn together after assembly to form a stressed arch structure. A lightweight, flexible sheet material may then be tautly secured over the arched frame to complete the structure, with additional bracing being added as required.

DESCRIPTION OF THE PRIOR ART

U.S. Pat. No. 2,144,747 issued to John Q. Adams on Jan. 24, 1939 describes a Collapsible Tent formed of multiple sections of preformed pipe or tube and suitable connectors. The structural members are all preformed to provide the desired angular and/or arched shapes prior to assembly, whereas the present structure is assembled from straight components as a flat, planar framework, and then arched to form a stressed arcuate structure by means of tension members secured to opposite edges of the framework.

U.S. Pat. No. 3,424,178 issued to Yoshimi Yazaki on Jan. 28, 1969 describes Small Size Constructions Which Are Readily Fabricated Or Dismantled, comprising a number of differently configured specialized components serving as connectors for a tubular framework structure. None of the components have any tensile forces applied thereto after assembly, to reform the structure into an arcuate or other shape, as provided by the present invention.

U.S. Pat. No. 3,800,814 issued to Wayne G. Hibbert on Apr. 2, 1974 describes a Back Pack Tent Of Quonset Design With Side Opening For Entrance. The framework comprises a plurality of small diameter rods, at least some of which are forced to a curvature to form the cross sectional shape of the tent. However, only two frame ends are provided, with the intermediate space being devoid of any frame structure. In order to hold the tent erect, opposite lines in tension are secured to each end, with the tent fabric therebetween being pulled taut. Accordingly, entrance and exit from the ends is precluded, and a side opening is provided, whereas the present structure utilizes a plurality of arcuate rib members to support the overlying closed cover material, and provides access through the open ends of the structure.

U.S. Pat. No. 3,855,643 issued to George N. Sanford et al. on Dec. 24, 1974 describes a Swimming Pool Covering Apparatus formed of a plurality of preformed curved or bowed components to provide the desired arcuate shape. The framework is anchored to the underlying deck by expansion bolts or the like. Permanent frame members are also installed at each end of the structure, unlike the present structure. The structure s not constructed of flat or straight components, as in the present invention.

U.S. Pat. No. 3,970,096 issued to William S. Nicolai on Jul. 20, 1976 describes a Tent having a framework formed of a series of ribs of small diameter tubular elements, with each rib comprising a plurality of members interconnected with an elastic cord through their centers. The tent is held erect by bowing the ribs to form an arcuate shape, and by pulling the tent cover taut from each end by opposite tension members. The result more closely resembles the Hibbert tent discussed above, than the present invention. Moreover, the tent covering must be specially constructed, as it includes pockets for the ribs and other elements not required in the conventional tarp covering of the present structure.

U.S. Pat. No. 4,121,604 issued to Lloyd H. Rain on Oct. 24, 1978 describes a Rigid Frame Structure With Tensioned Membrane Cladding, comprising a plurality of preformed arches which are permanently installed to a foundation by anchor bolts or the like. Each group of two arches is secured together at their tops, to provide resistance to end loads by forming a semi-geodetic configuration. The cover is applied in tension over the structure, by means of turnbuckles being used to draw it tight. No relationship is seen to the present structure, formed of a framework of straight components which are then forced into an arcuate structure.

German Patent Publication No. 291,755 to Gottschalk & Co. A-G and published on Sep. 9, 1916 describes a generally conventional pole supported tent structure, including an overlying fly. All compression members are straight poles, and all tensile members are cords or lines; no arcuate structural members, or straight members curved to form arcuate structures, are disclosed.

French Patent Publication No. 796,740 to Societe De Construction De Voles Aeriennes and published on Apr. 14, 1936 describes a conventionally shaped, gabled tent structure having a rigid framework. The covering may be gathered along cables or the like, to open the structure as desired.

None of the structure is either preformed or later formed into an arcuate structure.

Finally, British Patent Publication No. 623,900 to Reynolds & Co. et al. and accepted on May 25, 1949 describes Improvements In Or Relating To Collapsible Shelters, comprising a plurality of parallel ribs tied together by a series of rigid but foldable braces. Each of the ribs is preformed to provide an arcuate upper portion of the structure, unlike the present invention.

None of the above noted patents, taken either singly or in combination are seen to disclose the specific arrangement of concepts disclosed by the present invention.

SUMMARY OF THE INVENTION

By the present invention, an improved stressed arch construction, and structures constructed therefrom, is disclosed.

Accordingly, one of the objects of the present invention is to provide an improved construction wherein a substantially flat, planar framework is constructed of straight components and connectors therefor, and then formed into an arched structure by drawing opposite edges of the framework together.

Another of the objects of the present invention is to provide improved stressed arch structures which may be formed of a plurality of ribs which ends are drawn together to form a plurality of arches, with each arch of the structure being formed by one, two, or more closely adjacent ribs secured by common connectors.

Yet another of the objects of the present invention is to provide improved stressed arch structures which may be constructed substantially of conventional polyvinyl chloride or other plastic tubing, pipe, or the like, and which may make use of conventional fittings, and/or modified fittings or special purpose fittings.

Still another of the objects of the present invention is to provide improved stressed arch structures which are portable and are not required to be permanently secured in any one location.

A further object of the present invention is to provide an improved stressed arch structures which may be covered by a conventional tarp or the like, precluding need for costly: specialized covering material.

An additional object of the present invention is to provide improved stressed arch structures which may include supplemental bracing for additional strength as desired.

Another object of the present invention is to provide improved stressed arch structures wherein at least some components are fixedly secured together to preclude relative movement, and wherein other components may be secured together to permit relative axial rotation, to provide greater rigidity or flexibility as desired.

A final object of the present invention is to provide an improved stressed arch construction and structures for the purposes described which are inexpensive, dependable and fully effective in accomplishing their intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF TEE PREFERRED EMBODIMENTS

Figure 1:
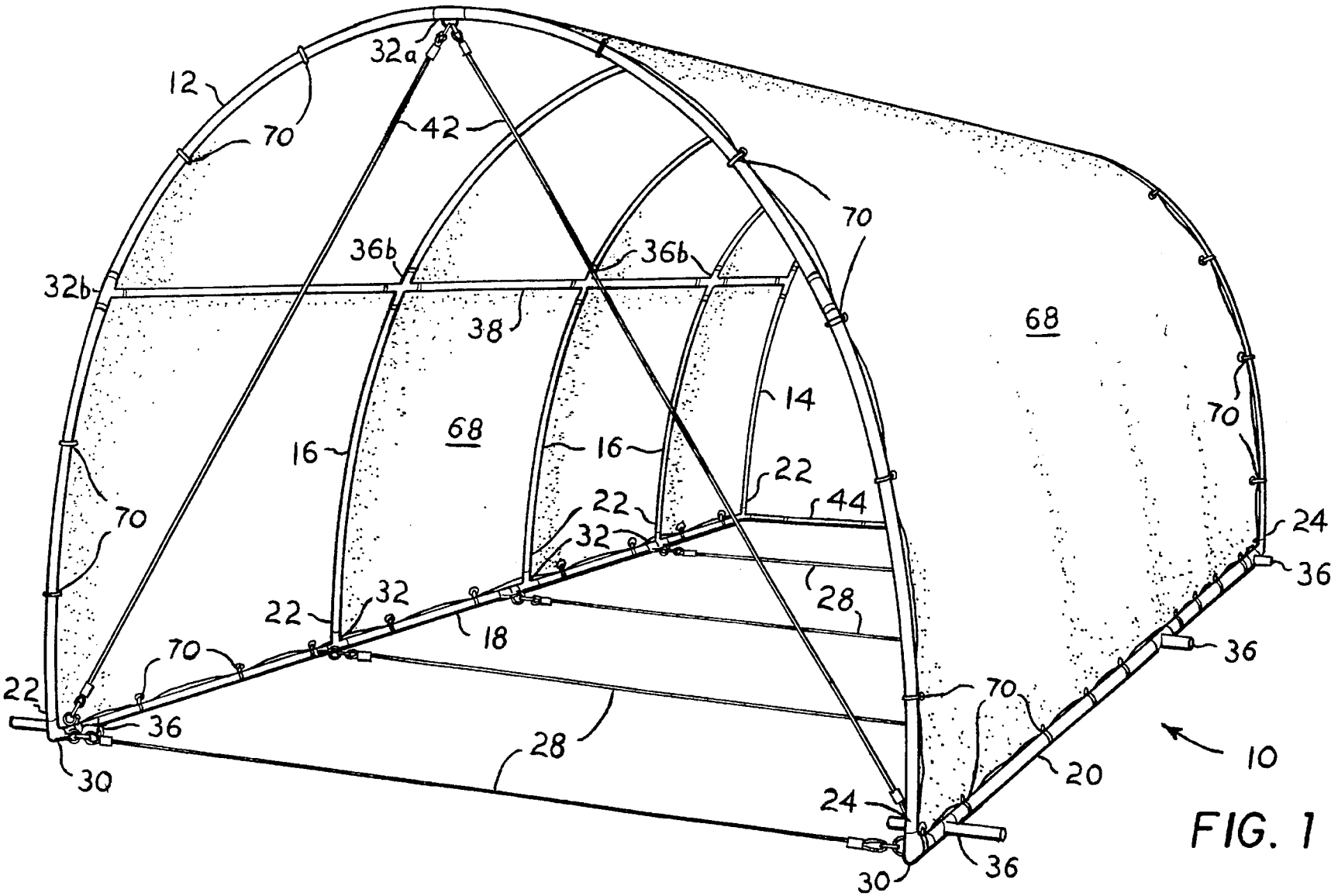
FIG. 1 is a perspective view of a completed and covered stressed arch structure of the present invention, showing its configuration and features.
Figure 2:
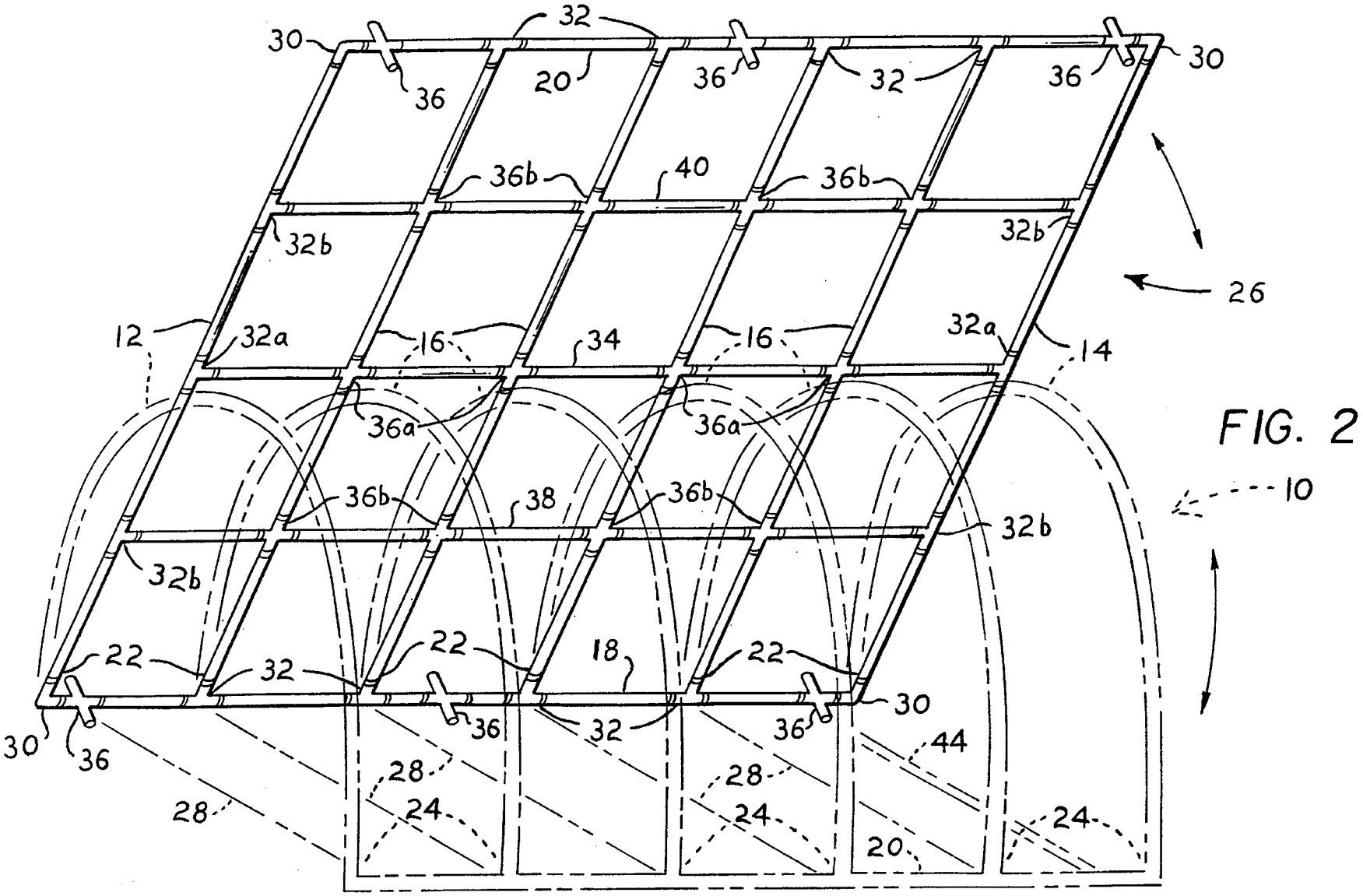
FIG. 2 is a perspective view of an assembled planar framework used to form a structure similar to that of FIG. 1, and showing the drawing together of opposite edges of the framework to form an arch structure.

Referring now particularly to FIGS. 1 and 2 of the drawings, the present invention will be seen to relate to a stressed arch structure 10, basically constructed of a first and opposite second end rib element 12 and 14 and a plurality of intermediate rib elements 16 with each rib element being of equal length and substantially parallel to one another, and a first and opposite second base member 18 and 20 secured respectively to the first ends 22 and second ends 24 of the rib members 12/14/16. Each of the above components 12 through 20 is preferably formed from a straight tubular section, which may comprise conventional polyvinyl chloride (PVC) or other plastic pipe. While PVC pipe or tubing and related components have been found to work well in the construction of a frame 26 for the present structure 10, other materials may be substituted for the above, as desired.

When the above frame 26 is completed, it will form an essentially flat, planar structure similar to that shown in solid lines in FIG. 2, due to the straight lengths of the components used therein. (It will be noted that only three intermediate ribs 16, and four bays, are shown in the structure of FIG. 1, while four intermediate ribs 16 and five bays are shown in the FIG. 2 structure. It will be understood that any number of intermediate ribs 16 may be used and spaced apart as desired, depending upon the anticipated loads, length needed, and other factors.) In order to form the stressed arch structure 10 of FIG. 1, a plurality of equal length tension members 28 are connected between the opposite first and second base members 18 and 20. As the tension members 28 (preferably steel cable, but other suitable materials may be used) are substantially shorter than the lengths of the ribs 12/14/16, and thus the span between the base members 18 and 20 to which the tension members 28 are secured, the frame 26 must be bowed to form a stressed arch structure 10, as shown in FIG. 1 and in broken lines in FIG. 2, in order to shorten the distance between the base members 18/20 to equal the length of the tension members 28.

The result will be seen to be an arched structure 10, wherein the rib elements 12/14/16 are forced from their relaxed straight condition to form an arch. The bending stresses in the ribs 12/14/16 result in a reasonably rigid yet very light weight structure 10, which rigidity may be increased further with additional refinements described in detail further below.

As an example of the above lengths and spans, the various rib elements 12/14/16 were each formed of two standard ten foot lengths of PVC pipe (for at total circumferential span on the order of twenty feet), and the tension members were each fabricated to length to provide a span of nine feet; such dimensions are well adapted to fit a boat trailer with a boat thereon, or a car or small camper van, etc. The maximum height of the arch of such a structure will be somewhat greater than the width, or on the order of some fifteen feet, depending upon the precise arcuate shape of the rib elements 12/14/16, any bracing installed (as discussed further below), etc. An arched structure having such dimensions will have a semi-elliptical cross sectional shape, rather than a semicircular shape. However, such a shape may be desirable for shedding rain or snow, or for other purposes. In any case, the cross sectional shape may be adjusted as desired, by altering the lengths of the rib elements 12/14/16 and/or the tension members 28 or additional diagonal or side bracing (discussed further below), as desired.

The use of standard PVC pipe (or other standard pipe or tubing) allows the use of standard, or slightly modified, connectors to be used in the assembly of the above structure 10. For example, standard (or slightly modified) elbow connectors 30 having an inside diameter closely fitting the outside diameter of the pipe or tubing of the frame 26, may be used to connect the first and second end ribs 12 and 14 to the first and second base members 18 and 20, to form the corners of the frame 26. Tee connectors 32 may be used to connect the ends 22 and 24 of the intermediate rib elements 16 to the first and second base members 18 and 20, with a slightly different connector **32*a* used to connect the first and second end ribs 12 and 14 to an intermediate member 34, which extends the length of the structure 10 at the crest of the structure when it is bent to form a completed structure 10. Finally, cross connectors 36 are used to connect the intermediate ribs 16 to the intermediate member 34, with connectors 36*a* used with any side braces 38 and 40 which may be installed parallel to the first and second base members 18 and 20 and to the intermediate or crest member 34. Such cross connectors 36 may also be installed along the first and second base members 18/20, with extensions therefrom positioned perpendicularly to the ribs 12/14/16 to serve as anchoring means for the structure 10** as described further below.

Figure 4:
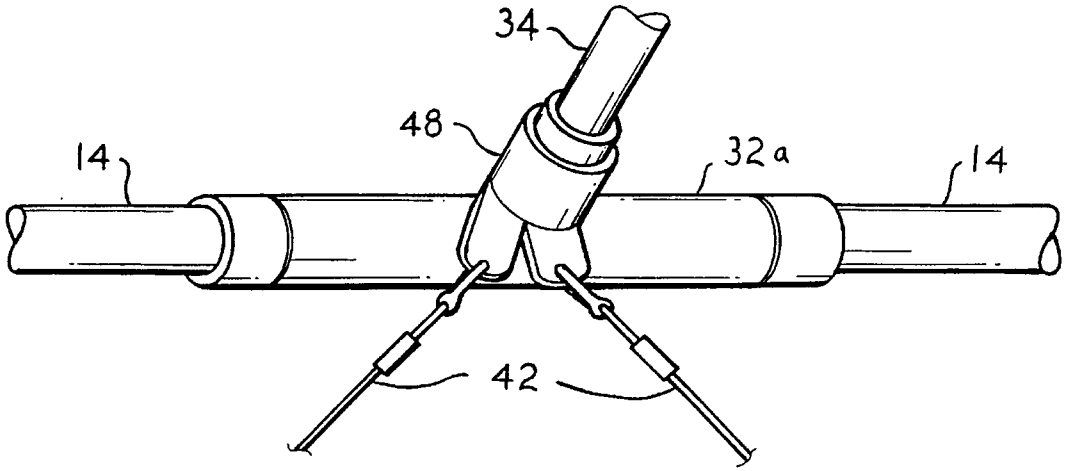
FIG. 4 is a broken away detail view of the crest portion of the end structure of FIG. 3, showing additional bracing details.
Figure 3:
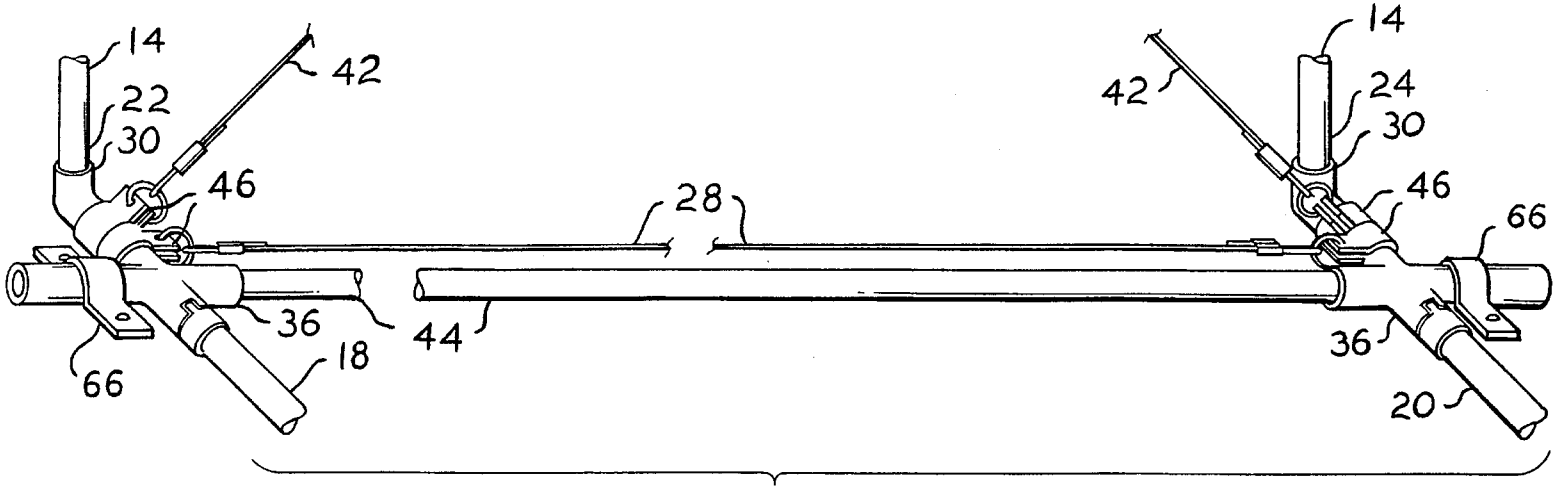
FIG. 3 is a broken away detail view of the base portion of one end of a structure formed in accordance with the present invention, and showing bracing details.

FIGS. 3 and 4 provide detail views of the diagonal tension braces 42 which may be incorporated into the present structure 10 as desired or required. These brace cables 42 assist in stabilizing the structure 10, to reduce or preclude any lateral movement or swaying due to wind loads, etc. While the cables 42 may be installed at virtually any point in the structure 10, preferably they are installed between the opposite ends of the intermediate or crest member 34, and the respective first and second base ends 22 and 24 of the first and second end rib elements 14 and 16, in order to keep the interior of the structure 10 clear. (FIGS. 3 and 4 show only the second end of the structure 10, along with a base compression crossmember 44 installed thereacross, with the bracing cables 42 of the first end being shown in FIG. 1.) Thus, the bracing cables 42 serve to triangulate each end of the structure 10 for additional rigidity.

The cables 42 are removably secured to left and right base cable clamps 46 by means of removable attachment rings, clevises, etc., which clamps 46 are installed around the opposite first and second ends of the two base members 18 and 20, or around the ends of any cross or elbow connectors 36 or 30. (Clamps 46 and associated hardware may also be used to secure the tension members 28 between the first and second base members 18 and 20.) The opposite upper ends of the cables 42 are removably secured to the intermediate or crest member 34 (or to a tee fitting 32 secured thereto) by means of an upper clamp or fitting 48 secured to the member 34 or to an attached tee fitting **32*a*. The upper cable clamp 48 includes two cable attachment ears or lugs, one for each of the cables 42 extending diagonally upwardly from the respective base members 18 and 20**.

The removable attachment means (clevises, rings, etc.) securing the cable ends to the clamps 46/48, allow one end of the cables 42 to be temporarily disconnected from the structure, thereby allowing for the placement within or removal from the structure 10 of a vehicle, boat, or other article, as desired. The cables 42 may be easily reinstalled when the vehicle/boat removal or placement is completed.

Figure 5:
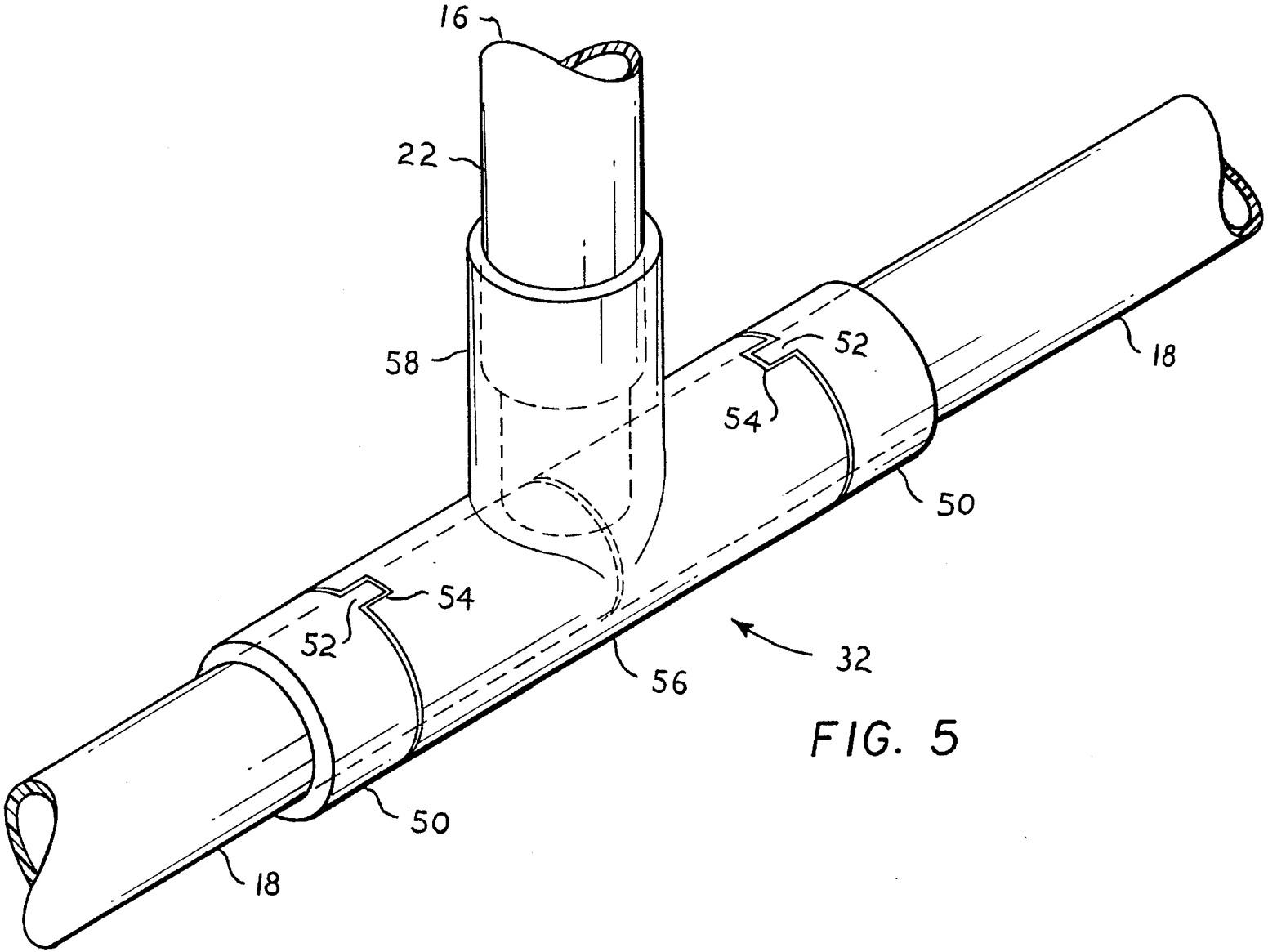
FIG. 5 is a broken away detail view of a typical base perimeter joint of the present invention.
Figure 6:
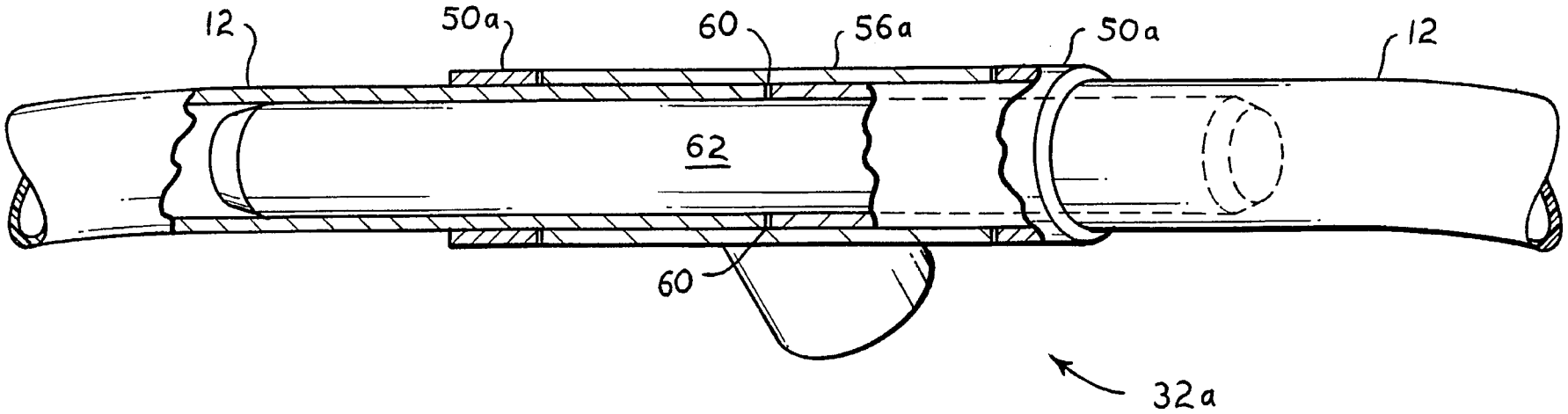
FIG. 6 a broken away detail view in partial section of the crest portion of a rib member of the present structure, showing details of the reinforcement thereof.
Figure 7:
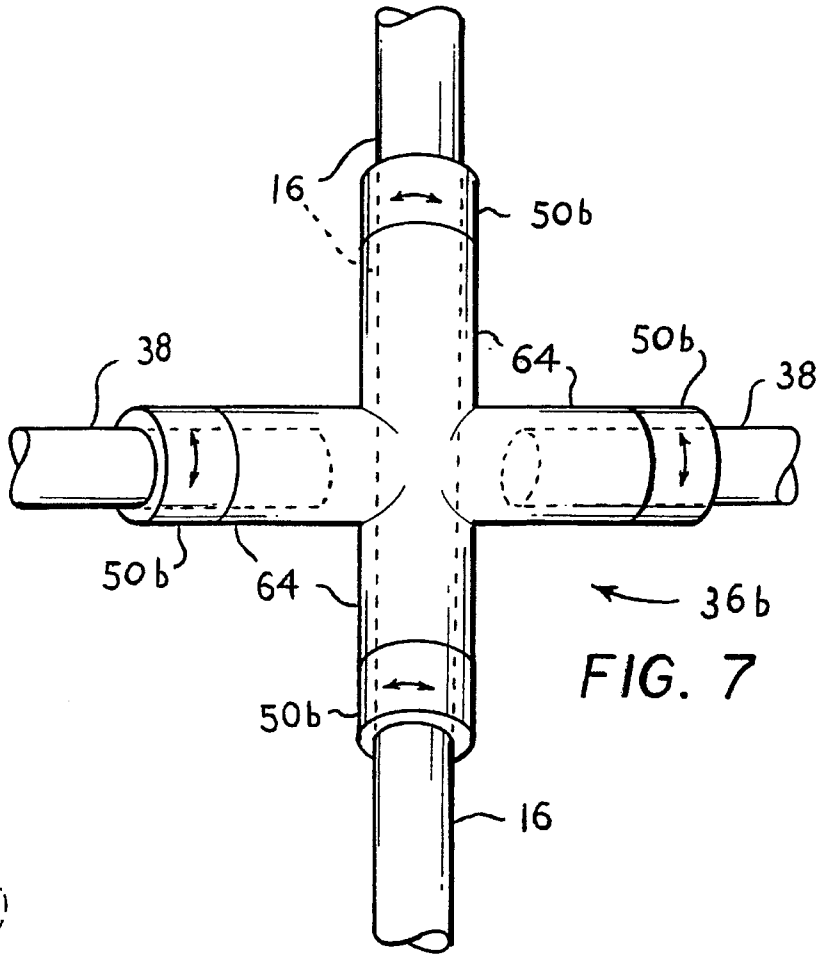
FIG. 7 is a broken away detail view of an intermediate brace member joint on a rib of the present structure, showing the relative axial rotation of the components for flexibility.

FIGS. 5 through 7 provide detail views of the various types of connectors used in the present structure 10, and modifications thereto which are made to suit more particularly the requirements of the present structure 10. FIG. 5 discloses a perspective view of a modified tee connector 32, as used between the first and second base members 18/20. It is important that these various components be precluded from relative rotation, and the modified tee connector 32 accomplishes this in a number of ways.

First, each base member section (e.g., the first base member 18) includes a collar 50 permanently and immovably secured (e.g., cemented, using appropriate glues/cements/solvents) thereto. The collars 50 each include a key 52, which is adapted to fit closely within a slot 54 formed in each end of the cross portion 56 of the tee. These collars 50 are aligned along each section of the base members 18/20, so that when they are assembled, the stem portions 58 of all the tee connectors 32 along a given base member 18/20, will be in alignment to ensure that the rib members 12/14/16 are coplanar when they are initially installed to form the flat, unstressed frame 26 before applying the tension members 28 to form the arch configuration.

The ends of the base member (e.g., 18) sections are also permanently and immovably cemented or otherwise secured within the cross portion 56 of the tees 32, for further structural strength. (It should be noted here that the above described construction requires that the base members 18/20 be formed of a plurality of shorter sections. This permits the present structure 10 to be formed to any length desired. However, longer sections could be passed through the cross portions 56 of the tees 32, if desired.)

Finally, stock tee connectors generally include a smaller diameter, necked down portion in the center of the cross portion of the tee configuration. This is to provide a stop for any tubing inserted therein, to preclude such inserted tubing from passing into the connector sufficiently far as to block flow between the stem portion of the tee and the cross portion thereof. However, for greater structural strength, this necked down portion is removed at least within the cross portion of the tee connectors 32 exemplified in FIG. 5, in order to allow insertion of the base member components to a greater depth. (The necked down portion is still shown in broken lines within the stem portion of the connector 32 in FIG. 5.) The sum total of the above modifications and assembly results in a connection which is quite durable and which highly resists twisting or relative axial motion between interconnected components.

FIG. 6 discloses a slightly different type of tee connector 32*a*, which is used to connect the first and second end rib elements 12 and 14 to the intermediate or crest member 34. As in the tee connector 32 described above, the internal passage through the cross portion 56*a* has been widened to provide for complete insertion of the rib elements (e.g., the first end rib 12) therethrough. It will be noted that each rib element 12 may comprise two halves, with the halves connected at the intermediate member by tee connectors 32*a* (for the end ribs 12 and 14) and cross connectors 36*a* (for the intermediate ribs 16). The joint 60 between the two rib halves may be seen in the broken away section view of FIG. 6. As the present structure 10 is adapted for the storage of relatively large articles, the total peripheral span of a single rib element may be larger than a stock length of material.

Even though the two ends of the rib halves may be inserted substantially to the center of the connector 32*a*, the bending stress imposed by forcing the essentially flat, planar frame 26 into the curved structure 10 by means of the tension cables 28, results in the tee connector 32*a* being highly stressed, as the discontinuous halves of the rib element provide no additional strength across the connector 32*a*. Accordingly, a solid stiffening rod 62 may be installed substantially centered within the two rib half ends, which are in turn essentially centered within the cross portion 56*a* of the tee connector 32*a*. Collars 50*a* may be installed on the ends of the rib halves in the manner of the collars 50 of the base member 18/20 sections, to preclude excessive insertion of either rib end into the connector 32*a*.

While no key and slot alignment is indicated in FIG. 6, such may be provided as desired, for alignment and/or standardization of components, if desired. Preferably, the stem portion 58*a* of the connector 32*a* is provided with such alignment means (not shown in FIG. 6 but essentially identical to the means shown on the cross portion 56 of the connector 32 of FIG. 5) in order to align the various components of the intermediate or crest member 34. The entire assembly is permanently assembled (glued, cemented, etc.), in the manner of the tee connector 32 of the base member 18/20 assembly discussed above.

A third type of tee connector 32*b* provides for the connection of the first and second side brace members 38 and 40 to the first and second end ribs 12 and 14. The primary function of these brace members 38/40 is to prevent compression of the end rib elements due to a cover being stretched tautly over the completed structure 10. While the intermediate crest member 34 serves this purpose at the top of the structure 10, some means of precluding such compression is also required along the sides of the structure 10. This connector 32*b* also has the cross portion widened to provide a sliding fit between the rib element 12/14 and the connector 32*b*, in the manner of the tee connector 32 of FIG. 5, to allow the connector 32*b* to rotate relative to the end rib 12/14 passing therethrouah. In addition the stem portion may be widened to allow the end of the side brace 38/40 to rotate relatively therein. While this specific fitting 32*b* is not shown in detail, it will be understood that the interior of the cross and stem portions of the fitting 32*b* is much like that provided for the cross portion 56 of the tee connector fitting 32 of FIG. 5, discussed above.

FIG. 7 discloses a third type of cross connector fitting 36*b*, adapted for connecting the side brace members 38/40 to the intermediate ribs 16. Each of the crossmembers 64 of the connector 36*b* has been internally widened to allow the connector 36*b* to rotate slightly relative to the rib element 16 and the side brace sections 38/40. The rib element 16 passes completely through the vertical crossmember of the cross connector 36*b*, while the side brace elements terminate within the connector; this is indicated by the broken lines within the connector body in FIG. 7. A collar 50*b* may be installed along the rib element 16, to either side of the cross connector 36*b*, in order to space the connector at the proper point along the rib element 16. Similar collars 50*b* are installed on either end of the side brace components 38/40, to preclude excessive insertion of the brace components within the connector 36*b*, to prevent their binding against the rib element 16. The above construction is similar to that described above for the cross portion of the tee connector 23*b*.

When the above construction has been completed, the finished structure 10 may be secured to the underlying surface if desired to preclude movement due to wind or other forces, by means of the anchor clamps 66 shown in FIG. 3. These clamps 66 are secured over one of the crossmembers of the cross connectors 36 (or over a relatively short section of tube or pipe extending therefrom), to anchor the structure 10 to the underlying surface, as desired. The structure 10 may then be covered by a frame cover 68 (tarp or tarps, or other sheet material) which may be secured to the perimeter of the structure 10 (i.e., the first and second rib elements 12/14 and first and second base members 18/20) by plastic ties 70, or other suitable means as desired. Closures (not shown) may be placed over the ends of the structure 10, if desired. The resulting structure 10 serves admirably as a lightweight, economical, and easily assembled shelter for the protection of various relatively large articles from the sun and elements.

In many areas of the country, substantial snow loads will be encountered during much of the year in any outdoor structure. While the first embodiment discussed above and disclosed in FIGS. 1 through 7 is preferably constructed of relatively lightweight materials for ease of construction and handling, and with the rib elements 12/14/16 disposed singly and relatively widely spaced, the present construction concept is also adaptable to a structure capable of supporting significant snow loads, by increasing the number of rib elements and decreasing their spacing. FIG. 9 shows such a structure 110, which is constructed generally along the lines of the structure 10 of the first embodiment discussed above, but which utilize various specialized connectors (FIGS. 8A through 8C) to provide the desired rib spacing.

The structure 110 of FIG. 9 provides the required strength for such snow loads, by providing first end, second end, and intermediate rib assemblies 112/114/116 in a parallel array, with each rib assembly comprising at least two rib elements immediately adjacent to one another. (While FIG. 9 shows two rib elements in each rib assembly 112/114/116, it will be understood that each rib assembly may comprise three, four, or more rib elements, if desired.) These rib assemblies connect to a first base member 118 and an opposite second base member 120, by means of the respective first rib assembly ends 122 and second rib assembly ends 124. The resulting frame is forcibly bent to form a curved structure 110, by means of connecting the opposite base members 118 and 120 together with a plurality of tension members 128, which members 128 are shorter than the length of the rib assemblies 112/114/116.

Figure 8A:
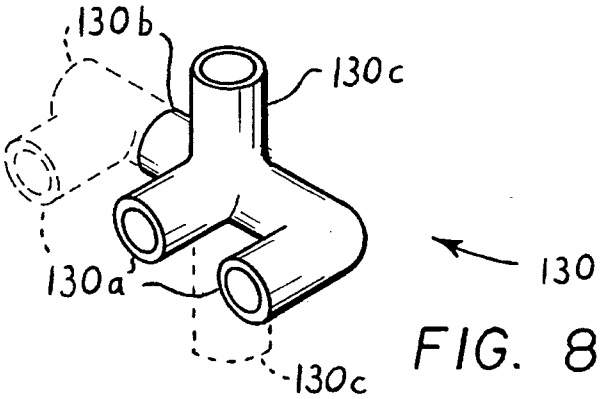
FIG. 8A is a perspective view of a fitting for an alternate embodiment structure, having adjacent plural rib members.
Figure 9:
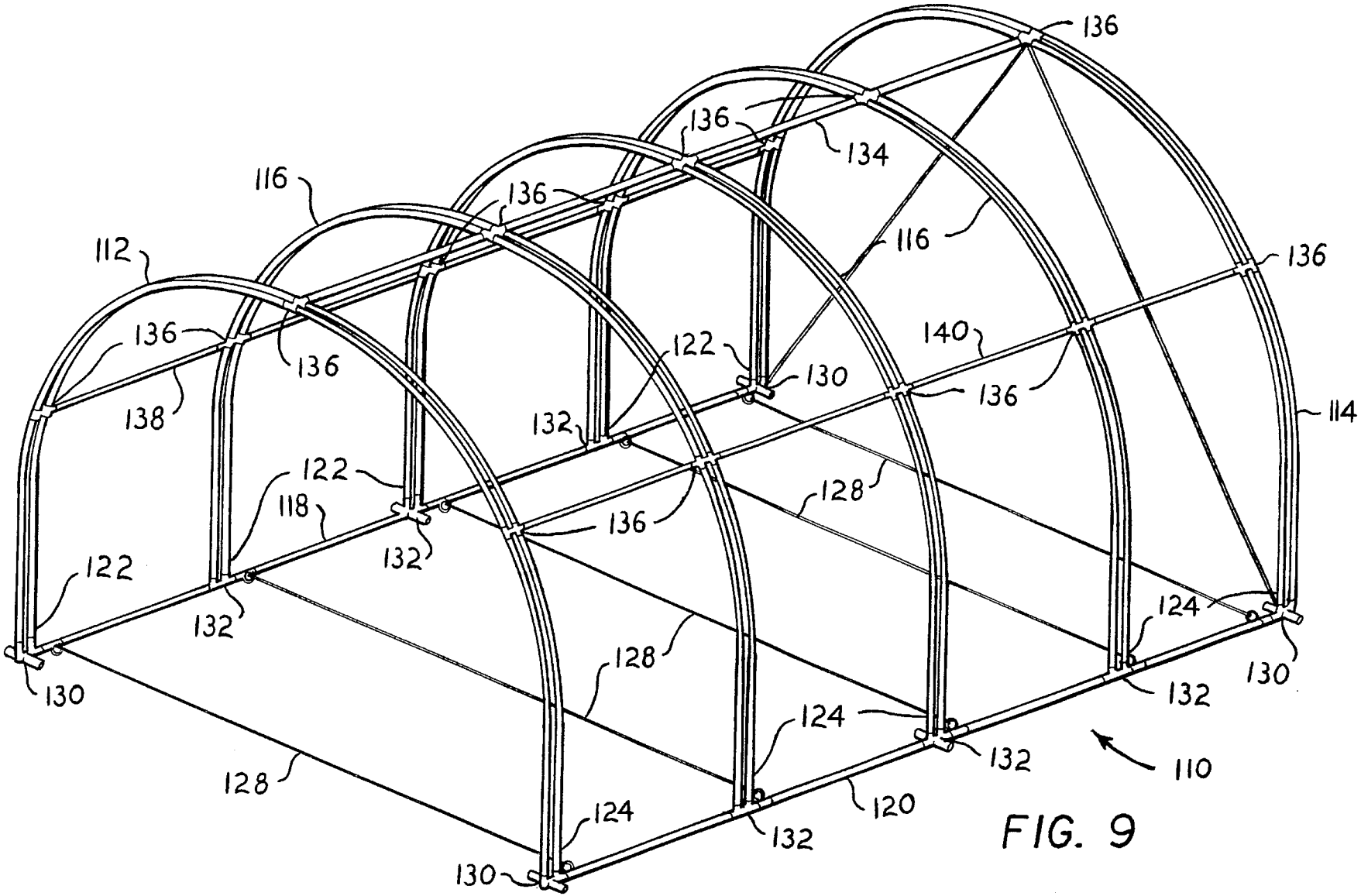
FIG. 9 is perspective view of plural rib structure using the connecting components of FIGS. 8A through 8C, and others.

The first end and second end rib assemblies 112 and 114 are connected to the first and second base members 118 and 120 at the corners of the structure 110, by means of multiple elbow connectors 130, shown in detail in FIG. 8A. Two (or more) rib end attachment extensions 130*a* are provided, with a base member attachment portion 130*b* at right angles thereto. An anchor extension 130*c* is provided, which would extend to the side of the attached base member to provide anchor means for the structure 110. (Opposite anchor extensions 130*c* are indicated in the general view of FIG. 9, with the second such extension 130*c* being shown in broken lines in FIG. 8A. It will be understood that the multiple elbow fitting of FIG. 8A is turned 90 degrees to its installed inclination, wherein the multiple rib elements of the rib assembly would project generally vertically upward from the rib end attachment portions 130*a*.)

Figure 8B:
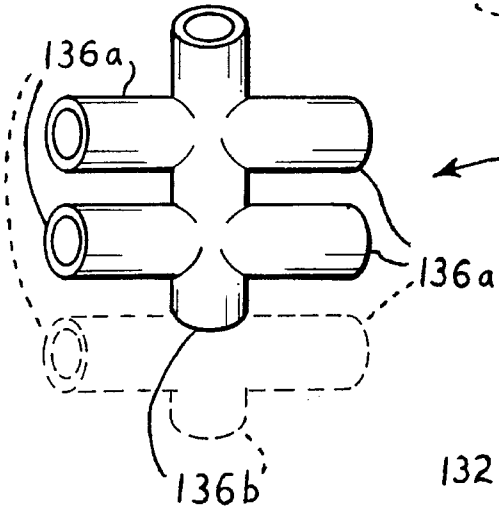
FIG. 8B is perspective view of another plural rib fitting.
Figure 8C:
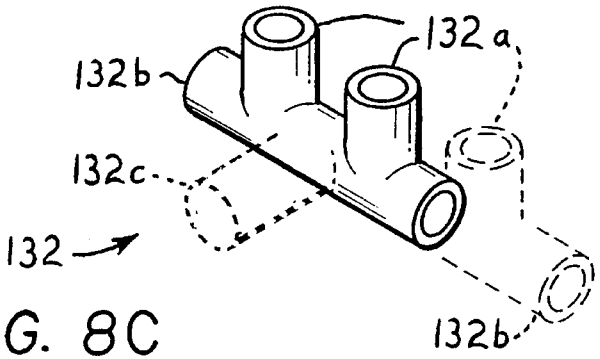
FIG. 8C is perspective view of another plural rib fitting.

FIG. 8C discloses a modified tee connector 132, used to connect the ends 124 of the intermediate rib assemblies 116 to the first and second base members 118 and 120. This tee connector 132 includes multiple (two or more) connector extensions 132*a* providing connection to multiple rib elements of an intermediate rib assembly 116, and to base member attachment extensions 132*b*. A lateral anchor extension 132*c* may be provided, whereby an anchor clamp may be secured thereover to prevent movement of the structure 110.

A modified cross connector 136 is disclosed in FIG. 8B, for connection of the multiple intermediate rib assemblies 116 to an intermediate member 134, and also for connecting the rib assemblies 116 to a first and second side brace member 138 and 140 (depending upon the internal structure of the connector 136). Multiple rib element attachment portions 136*a* are provided, with sections of the intermediate member 134 connecting to the two opposite attachment portions 136*b*. (It will be seen that a modified cross connector 136, wherein one of the intermediate member attachment portions 136*b* is deleted, will serve to connect the intermediate member 134 and the first and second side braces 138 and 140 to the first and second end rib assemblies 112 and 114, as shown in FIG. 9.)

Any of the above multiple connectors 130. 132, and 136 may be modified in the manner described further above in the discussion of the first embodiment of structure 10 for equivalent connectors 32, and 36 of that embodiment. For example, the multiple cross connectors may be widened internally An order to provide a sliding fit for all component inserted therein, to allow relative rotational freedom. For those connectors used in assembling the intermediate member 134 to the rib assemblies 112/114/116, a stiffening element may be provided between the rib element ends.

As in the first embodiment of FIGS. 1 through 7, additional diagonal bracing 142 may be provided at the two ends of the structure 110. (While bracing cables 142 are shown only at the second end of the structure 110 of FIG. 9, it will be understood that these cables 142 are substantially similar to those shown at the first and second ends of the structure 10 respectively in FIGS. 1 and 3 through 4 of the drawings, and may also readily be installed in the first end of the structure 110.) The bracing cables 142 may be removed as desired to allow vehicles or other large objects to be installed within and removed from the structure 110 as desired, in the manner of the cables 42 of the first embodiment structure The remainder of the structure and components of the second embodiment structure 110 of FIG. 9, are similar to the components previously discussed above for the structure 10 of the first embodiment. For example, a base compression member (not shown) may be installed across the second end of the structure 110 between the first and second base members 18 and 20, in the manner of the base compression member 44 of the structure 10. Other hardware (collars, clamps, etc.) may also be fitted as required. The two structures 10 and 110 will be seen to be quite similar, with the primary difference being the closely spaced pairs (or alternatively greater quantities) of rib elements comprising each rib assembly in the structure 110. As in the case of the structure 10 of FIG. 1, the structure 110 may be covered with a suitable frame cover substantially similar to the frame cover 68 of the structure 110 of FIG. 1, and secured in a similar manner. The resulting structure 110 serves nicely a shelter for larger articles, and is also capable of withstanding substantial snow loads.

In summary, the stressed arch structures of the present invention will be seen to provide economical yet reasonably durable temporary or semi-permanent shelter for various relatively large articles, such as (but not limited to) boats, automobiles and motor homes, etc. The shelters also serve well as garden or yard sheds, and may be scaled upward or downward as required for the specific application. The present structures are relatively light, and are subject to movement due to wind or other causes. Accordingly, anchor means are provided in the form of lateral extensions from the base members, adapted to be clamped to the underlying surface by means of suitable clamps. It s also possible to anchor the present structures by positioning the wheels of a vehicle or trailer stored therein, to rest upon one or more of the tension members extending laterally between the two base members of a structure, and which hold the arcuate form of structure.

The present structure serves admirably as protection for a boat which is trailered or otherwise removed from the water, or alternatively the structure may be assembled over a boat slip, extending across the two opposite docks of the slip to provide shelter for a boat moored in the slip. The tension members may be deleted in such an installation in order to keep the span open, with the base members anchored to the relatively immovable docks.

Thus, the present structures are extremely versatile, economical, and easy to assemble, yet provide excellent temporary or semi-permanent protection from the elements for articles stored therein. The shelter of the second embodiment is capable of supporting significant snow loads due to the multiple rib elements of each rib assembly, and thus provides year round shelter for articles stored therein.

It is to be understood that the present invention is not limited to the sole embodiments described above, but encompasses any and all embodiments within the scope of the following claims.

I claim:

1. A stressed arch structure, comprising:

a first end and an oppositely disposed second end rib element and a plurality of intermediate rib elements each comprising a tube of equal length and each having a first end and an opposite second end, said rib elements disposed in a parallel array;

a first and a second straight tubular base member, each secured respectively to each said first end and each said second end of said rib elements to define a frame;

a tubular intermediate member connected to each of said rib elements between said first and said second base member and parallel thereto;

said rib elements, each said base member, and said intermediate member each being a straight, uncurved tube in its unstressed and unassembled state and being disposed to define a flat, planar surface when assembled together;

a plurality of equal length tension members each having a length shorter than said length of each of said rib elements, said tension members being connected between said first base member and said second base member in a parallel array to stress and urge said frame into an arcuate structure, and;

a frame cover secured at least to each said base member and to said first end and said second end rib element, whereby;

said stressed arch structure is adapted to provide temporary and semi-permanent protection for boats, automobiles, and other equipment and articles.

2. The stressed arch structure of claim 1, including:

a plurality of tee connectors serving to secure said first and said second base member to said intermediate rib elements;

a plurality of elbow connectors serving to secure first and second base member to said first and said second end rib element, and;

a plurality of cross connectors serving to secure at least said intermediate member to said intermediate rib elements, and;

each of said connectors having a tubular configuration and being formed of a plastic material.

3. The stressed arch structure of claim 1, including:

diagonal tension braces removably secured between said first end of said first end rib element and said intermediate member, said second end of said first end rib element and said intermediate member, said first end of said second end rib element and said intermediate member, and said second end of said second end rib element and said intermediate member.

4. The stressed arch structure of claim 1, including:

a first and a second side brace disposed respectively between said first base member and said intermediate member, and said second base member and said intermediate member and parallel thereto, with each said side brace serving to secure said intermediate rib elements and said first and said second end rib element to one another to preclude relative movement therebetween.

5. The stressed arch structure of claim 1, including:

a plurality of cross connectors disposed along each said base member and rigidly secured thereto at right angles to said rib elements, said cross connectors each having a tubular configuration and being formed of a plastic material and comprising anchor means for said structure.

6. The stressed arch structure of claim 1, wherein:

each of said rib elements comprises a first half and a second half, with each said half having an intermediate end and an opposite base end;

said structure includes a plurality of rib cross connectors and tee connectors, with said rib connectors each having a tubular configuration and being formed of a plastic material, and;

each said intermediate end of each said half of each of said rib elements is rigidly joined to said intermediate member by one of sad rib connectors to provide a plurality of intermediate joints.

7. The stressed arch structure of claim 6, including:

a solid elongate stiffening member installed within each of said rib connectors and extending therethrough and into each corresponding said intermediate end of each said rib half, with each sad stiffening member serving to stiffen a corresponding one of said intermediate joints to preclude weakening of said rib cross connectors due to bending stresses developed in said rib elements by said tension members holding sad frame to form said stressed arch structure.

8. The stressed arch structure of claim 1, wherein:

each of said rib elements and each of said base members is formed of a plastic tube.

9. The stressed arch structure of claim 1, wherein:

each of said tension members is formed of a steel cable.

10. The stressed arch structure of claim 1, wherein:

said frame cover comprises at least one tarp drawn over said frame.

11. A stressed arch structure, comprising:

a first end and an oppositely disposed second end rib assembly and a plurality of intermediate rib assemblies, each comprising a plurality of adjacent tubular rib elements of equal length and each having a first end and an opposite second end, said rib assemblies disposed in a parallel array;

a first and a second straight tubular base member, each secured respectively to each said first end and each said second end of said rib assemblies to define a frame;

a tubular intermediate member connected to each of said rib assemblies between said first and said second base member and parallel thereto;

said rib elements of said rib assemblies, each said base member, and said intermediate member each being a straight, uncurved tube in its unstressed and unassembled state and being disposed to define a flat, planar surface when assembled together;

a plurality of equal length tension members each having a length shorter than said length of each of said rib assemblies, said tension members being connected between said first base member and said second base member in a parallel array to stress and urge said frame into an arcuate structure, and;

a frame cover secured at least to each said base member and to said first end and said second end rib assembly, whereby;

said stressed arch structure is adapted to provide temporary and semi-permanent protection for boats, automobiles, and other equipment and articles.

12. The stressed arch structure of claim 11, including:

a plurality of multiple tee connectors serving to secure said first and said second base member to each of said rib elements of each of said intermediate rib assemblies;

a plurality of multiple elbow connectors serving to secure first and second base member to each of said rib elements of said first and said second end rib assembly, and;

a plurality of multiple cross connectors serving to secure at least said intermediate member to each of said rib elements of said intermediate rib assemblies and;

each of said multiple connectors having a tubular configuration and being formed of a plastic material.

13. The stressed arch structure of claim 12, wherein:

at least some of said multiple tee connectors and said multiple elbow connectors include lateral extensions therefrom, disposed at right angles to said rib assemblies and said base members and comprising anchor means for said structure.

14. The stressed arch structure of claim 11, including:

diagonal tension braces removably secured between said first end of said first end rib assembly and said intermediate member, said second end of said first end rib assembly and said intermediate member, said first end of said second end rib assembly and said intermediate member, and said second end of said second end rib assembly and said intermediate member.

15. The stressed arch structure of claim 11, including:

a first and a second side brace disposed respectively between said first base member and said intermediate member, and said second base member and said intermediate member and parallel thereto, with each said side brace serving to secure said intermediate rib assemblies and said first and said second end rib assembly to one another to preclude relative movement therebetween.

16. The stressed arch structure of claim 11, wherein:

each of said rib elements of said rib assemblies comprises a first half and a second half, with each said half having an intermediate end and an opposite base end;

said structure includes a plurality of rib multiple cross connectors and tee connectors, with said rib connectors each having a tubular configuration and being formed of plastic material, and;

each said intermediate end of each said half of each of said rib elements comprising said rib assemblies, is rigidly joined to said intermediate member by a respective one of said multiple rib connectors to provide a plurality of multiple intermediate joints.

17. The stressed arch structure of claim 16, including:

a plurality of solid elongate stiffening members installed within each of said multiple rib connectors and extending therethrough and into each corresponding said intermediate end of each said rib element half, with each of said stiffening members serving to stiffen a corresponding one of said multiple intermediate joints to preclude weakening of said rib cross connectors due to bending stresses developed in said rib elements by said tension members holding said frame to form said stressed arch structure.

18. The stressed arch structure of claim 11, wherein:

each of said rib elements of each of said rib assemblies and each of said base members is formed of a plastic tube.

19. The stressed arch structure of claim 11, wherein:

each of said tension members is formed of a steel cable.

20. The stressed arch structure of claim 11, wherein:

said frame cover comprises at least one tarp drawn over said frame.

* * * * *